US008678766B1

(12) United States Patent
Liang

(10) Patent No.: US 8,678,766 B1
(45) Date of Patent: Mar. 25, 2014

(54) TURBINE BLADE WITH NEAR WALL COOLING CHANNELS

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 156 days.

(21) Appl. No.: 13/539,714

(22) Filed: Jul. 2, 2012

(51) Int. Cl.
*F01D 5/08* (2006.01)

(52) U.S. Cl.
USPC ..... 416/97 R

(58) Field of Classification Search
CPC ..... F01D 5/085; F01D 5/087; F01D 5/088
USPC ..... 416/97 A, 97 R
See application file for complete search history.

(56) References Cited

U.S. PATENT DOCUMENTS

| | | | | |
|---|---|---|---|---|
| 4,221,539 | A * | 9/1980 | Corrigan | 416/97 A |
| 6,705,836 | B2 * | 3/2004 | Bourriaud et al. | 416/97 R |
| 7,534,089 | B2 * | 5/2009 | Liang | 416/97 R |
| 7,862,299 | B1 * | 1/2011 | Liang | 416/97 R |
| 8,292,582 | B1 * | 10/2012 | Liang | 416/97 R |
| 8,500,401 | B1 * | 8/2013 | Liang | 416/1 |
| 8,535,004 | B2 * | 9/2013 | Campbell | 416/97 R |

* cited by examiner

*Primary Examiner* — Nathaniel Wiehe
*Assistant Examiner* — Brian O Peters
(74) *Attorney, Agent, or Firm* — John Ryznic

(57) ABSTRACT

A turbine rotor blade with a low flow cooling circuit that includes a number of upward flowing and downward flowing near wall cooling channels connected by tip floor near wall cooling channels to provide cooling for the walls of the blade. Cooling air is supplied from the root supply cavity and flows through the near wall channels and then discharges into a collector cavity formed within the airfoil walls. The spent cooling air is then discharged through trailing edge exit holes to cool the trailing edge region.

7 Claims, 4 Drawing Sheets

Line A-A

Line A-A

TURBINE BLADE WITH NEAR WALL COOLING CHANNELS

CROSS-REFERENCE TO RELATED APPLICATIONS

None.

GOVERNMENT LICENSE RIGHTS

None.

BACKGROUND OF THE INVENTION

1. Field of the Invention

The present invention relates generally to a gas turbine engine, and more specifically to a turbine rotor blade with a low flow cooling circuit.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

A third stage vane or blade requires less cooling than the first two stages, but still requires some cooling in order to prevent a shortened life. Since film cooling is not required in a third stage airfoil, low cooling flow designs are desired in order to save on the use of cooling air. The cooling air for the airfoils in the turbine is bled off from the compressor and not used to produce useful work in the engine. Thus, the energy used to compress the cooling air is wasted in the engine. Using less cooling air for a stage or airfoils would increase the overall efficiency of the engine therefore.

BRIEF SUMMARY OF THE INVENTION

A turbine rotor blade with a low flow cooling circuit that includes a number of near wall cooling channels and tip floor cooling channels connected in series to provide convection cooling for the blade walls and tip floor. Each channel includes an upward flowing near wall cooling channel connected through a near wall tip floor cooling channel to a downward flowing near wall cooling channel, which discharges into a cooling air collector cavity formed within the airfoil walls.

Cooling air from a supply cavity formed in the blade root flows up through the upward flowing near wall cooling channel and then into the tip floor near wall cooling channel, where it turns and flow into the downward flowing near wall cooling channel to provide cooling for the pressure side wall or the suction side wall. The cooling air from the downward flowing channels is discharged into the collector cavity where the spent cooling air then flows out through the trailing edge exit holes to provide cooling for the trailing edge region.

DETAILED DESCRIPTION OF THE INVENTION

Figure 1:
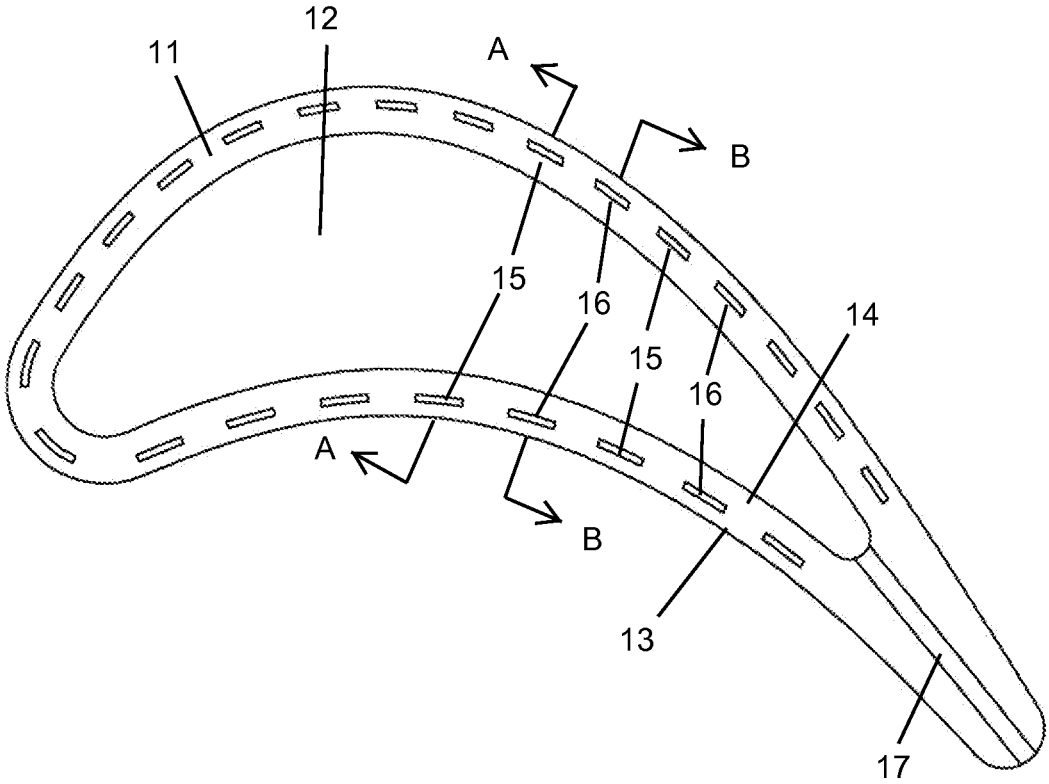
FIG. 1 shows a cross section top view of the counter flow near wall serpentine cooling circuit for a turbine blade of the present invention.

The present invention is a turbine rotor blade, especially for a turbine rotor blade of an industrial gas turbine engine, having a low flow cooling circuit that produces near wall cooling of the airfoil walls using less cooling air than prior art blade designs. The design also provides for use of the near wall cooling air to also provide near wall cooling for the blade squealer tip floor. FIG. 1 shows a cross section view of the blade with the near wall cooling channels. The blade includes an airfoil wall 11 that defines a spent cooling air collector cavity 12 within the walls. The airfoil wall has a number of near wall cooling channels 15 and 16 formed within the walls on the pressure side and the suction side. The airfoil wall 11 has a thicker inner wall 14 than the thinner outer wall 13. A row of trailing edge cooling holes 17 is connected to the collector cavity 12 and discharges the spent cooling air from the blade.

Figure 2:
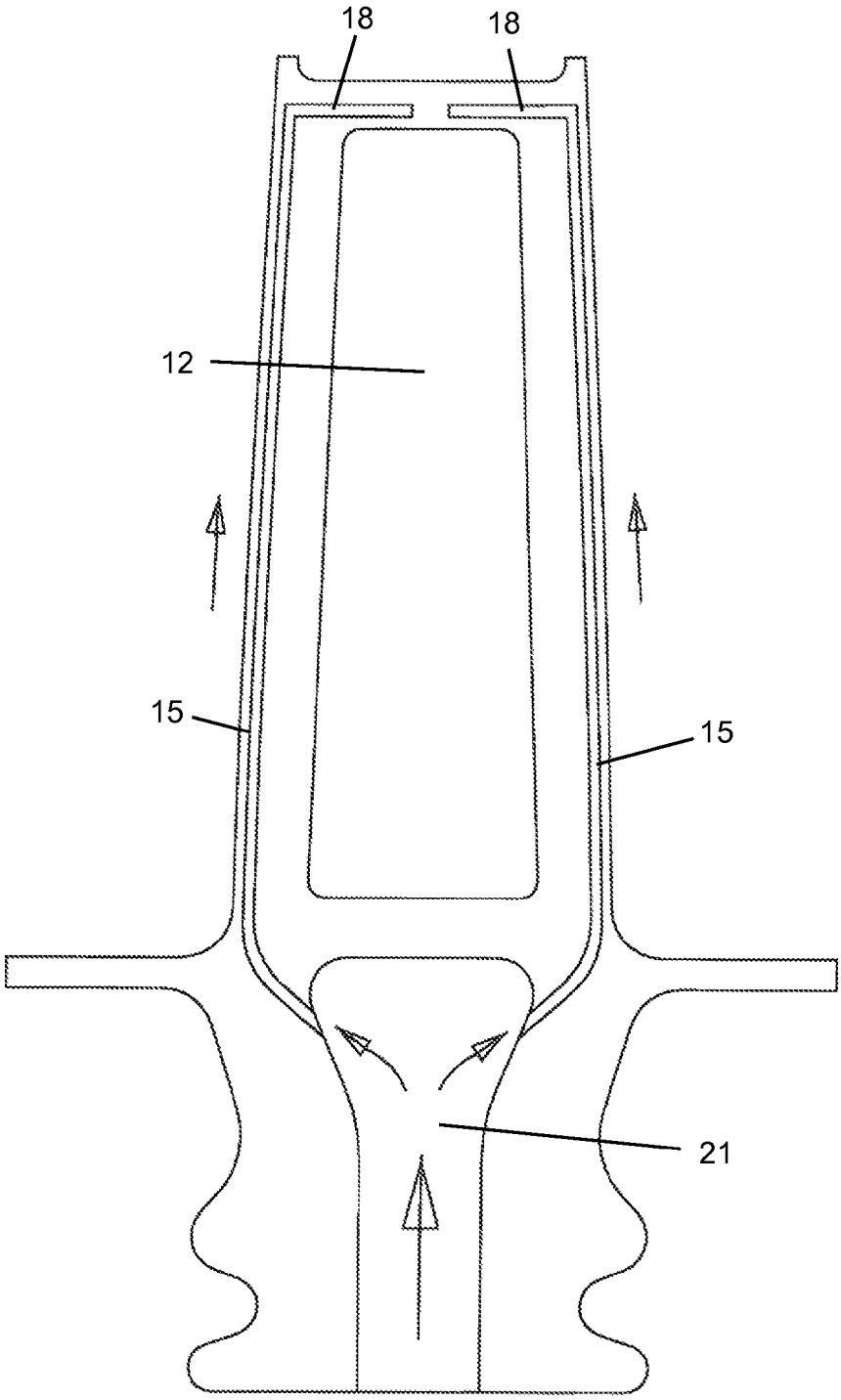
FIG. 2 shows a cross section side view of the turbine blade of the present invention with the upward flowing near wall cooling channels for the blade of the present invention.

FIG. 2 shows a cross section side view of the blade of FIG. 1 through line A-A with upward flowing near wall cooling channels 15 connected to a cooling air supply cavity 21 formed in the blade root and extending up along the airfoil walls of the pressure and suction sides. The upward flowing channels 15 then turn and flow along tip floor cooling channels 18. The tip floor cooling channels 18 are connected to tip floor cooling channels 19 shows in FIG. 3.

Figure 3:
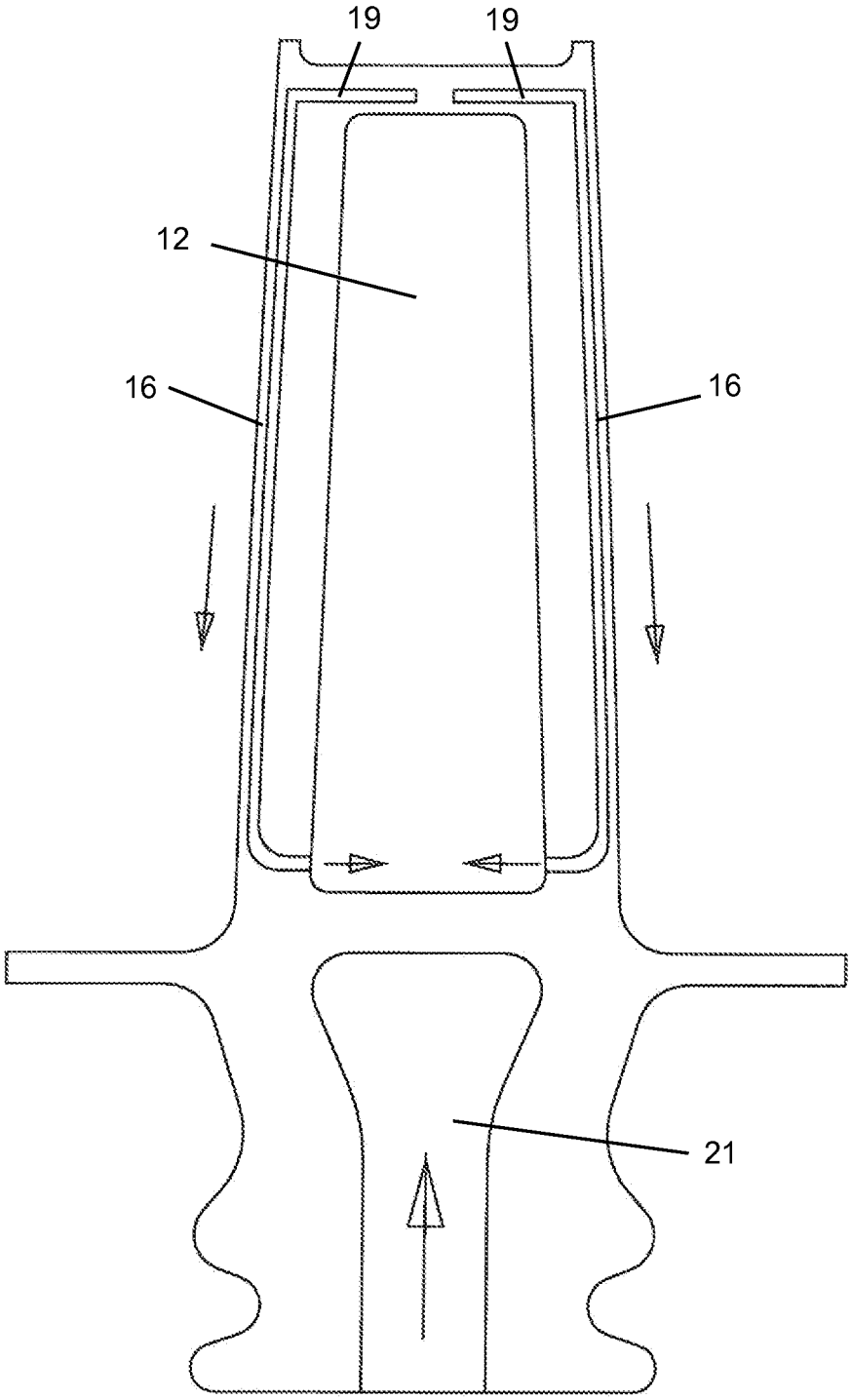
FIG. 3 shows a cross section side view of the turbine blade of the present invention with the downward flowing near wall cooling channels for the blade of the present invention.

The tip floor cooling channels 19 in FIG. 3 flow into the downward flowing near wall cooling channels 16 to provide near wall cooling for the pressure and suction side walls and then flow into the collector cavity 12.

The near wall cooling circuit of the present invention thus includes a series of cooling channels that start from the cooling air supply cavity 21 and flow up toward the blade tip, turn at the blade tip, flow down along the airfoil walls, and then discharge into the common collector cavity 12. This near wall cooling circuit is repeated along the airfoil walls from the leading edge region to the trailing edge region as seen in FIG. 1. All of the cooling air discharged into the collector cavity 12 is then discharged through the row of trailing edge exit holes 17.

Figure 4:
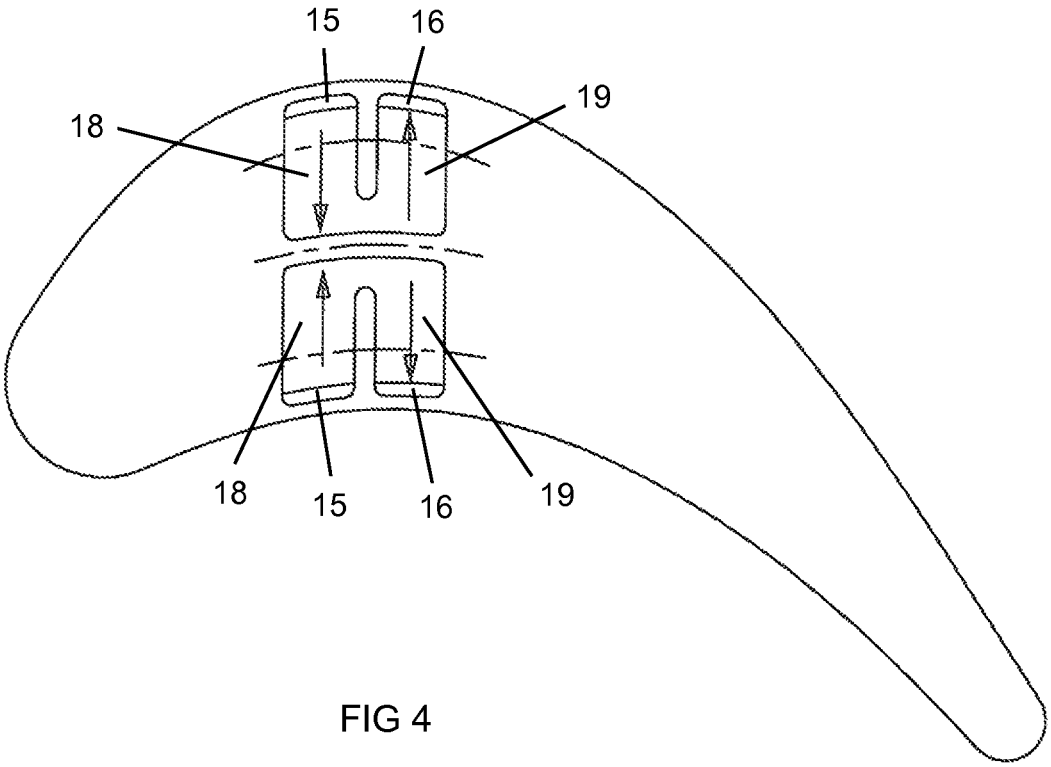
FIG. 4 shows a cross section top view of the near wall cooling channels in the squealer tip floor for the blade of the present invention.

FIG. 4 shows a cross section top view of the blade tip floor near wall cooling channels 18 and 19 with the turn channels that connect the upward flowing channels 15 to the downward flowing channels 16.

Trip strips can be used along the near wall cooling channels to promote heat transfer from the hot metal surfaces to the flowing cooling air. The up and down flow of the cooling air with the tip turns produces a more uniform metal temperature for the airfoil walls and less thermally induced stress. The spent cooling air from the airfoil walls and tip can then be used to provide cooling for the trailing edge region. In the design of the present invention, the cooling air provides the airfoil main body with near wall cooling and the squealer tip floor cooling first before cooling of the trailing edge region. This triple use for the cooling air (the airfoil walls, the tip floor, and then the trailing edge region) provides for a low flow cooling capability that will increase the engine efficiency and power output.

To form the blade with small near wall cooling channels for a blade with a thin airfoil wall, a metal printing process can be used to form the blade with the cooling air features in one process. A metal printing process such as that developed by Mikro Systems, Inc. of Charlottesville, Va. can be used to print a metal blade with the cooling channels having a size much smaller than could be formed from the investment casting process that uses a ceramic core or printed with features that are too complex or too small to be formed from the investment casting process using a ceramic core. The blade outer wall can be as thin as 0.01 to 0.015 inches in thickness from the cooling channels 15 and 16. This small size cannot be formed from a ceramic core in the investment casting process. Smaller cooling air channels allow for more channels to be used, and with more and smaller channels a larger convection surface area is formed. A larger convection surface area will produce higher cooling capability.

I claim the following:

1. A turbine rotor blade comprising:

an airfoil wall with a pressure side wall and a suction side wall;

a cooling air collector cavity formed within the airfoil wall;

a blade root with a cooling air supply cavity;

a blade tip floor;

an upward flowing near wall cooling channel formed in the pressure side wall and the suction side wall and connected to the cooling air supply cavity;

a downward flowing near wall cooling channel formed in the pressure side wall and the suction side wall and adjacent to the upward flowing near wall cooling channel;

tip floor near wall cooling channels with turn channels formed in the blade tip floor;

the tip floor near wall cooling channels connecting the upward flowing near wall cooling channels to the downward flowing near wall cooling channels;

the downward flowing near wall cooling channels connected to the cooling air collector cavity; and, a row of exit holes in the trailing edge region connected to the cooling air collector cavity.

2. The turbine rotor blade of claim 1, and further comprising:

the tip floor near wall cooling channels with tip turn channels are U-shaped.

3. The turbine rotor blade of claim 1, and further comprising:

the airfoil wall includes an outer wall with a thickness of 0.01 to 0.015 inches from an outer surface of the airfoil wall to the near wall cooling channels.

4. The turbine rotor blade of claim 1, and further comprising:

the blade is without film cooling holes connected to the near wall cooling channels.

5. The turbine rotor blade of claim 1, and further comprising:

the tip floor near wall cooling channels with tip turn channels cover nearly all of the tip floor surface area.

6. The turbine rotor blade of claim 1, and further comprising:

the upward flowing and downward flowing near wall cooling channels cover the airfoil wall from a leading edge to a trailing edge region.

7. The turbine rotor blade of claim 1, and further comprising:

each upward flowing and downward flowing near wall cooling channel and associated tip floor cooling channels forms a closed loop cooling passage from the cooling air supply cavity to the cooling air collector cavity.

* * * * *